United States Patent [19]

Gjesdal

[11] 4,280,900

[45] Jul. 28, 1981

[54] ROTARY SEED CLEANER

[76] Inventor: J. Harvey Gjesdal, Box 245, Birch Hills, Saskatchewan, Canada, S0J 0G0

[21] Appl. No.: 124,290

[22] Filed: Feb. 25, 1980

[51] Int. Cl.[3] ..... B07B 15/00

[52] U.S. Cl. ..... 209/34; 209/241; 209/284; 209/289; 209/292

[58] Field of Search ..... 209/12, 30, 31, 34, 209/35, 136, 137, 247, 284, 288, 289, 292, 293, 389, 390, 241; 56/16.5

[56] References Cited

U.S. PATENT DOCUMENTS

| | | | |
|---|---|---|---|
| 2,735,226 | 2/1956 | Franks et al. | 209/292 X |
| 3,036,706 | 5/1962 | Taudiere | 209/389 X |
| 3,051,311 | 8/1962 | Dettling | 209/288 X |
| 3,107,476 | 10/1963 | Gustafson | 209/12 X |
| 3,373,871 | 3/1968 | Huether | 209/35 X |
| 3,394,808 | 7/1968 | Thompson | 209/247 X |
| 3,823,819 | 7/1974 | Bakke | 209/12 |

*Primary Examiner*—William A. Cuchlinski, Jr.
*Attorney, Agent, or Firm*—Stanley G. Ade

[57] ABSTRACT

The seed cleaner comprises a scalper drum which drives an auger pick up and which separates all materials thicker than the desired seed such as head, stalks and the like. The remaining fraction then passes through an air cleaner which removes chaff, dust and light fractions. The remainder is fed into a pair of shells or drums which screen out seed and the like which is thinner than the desired fraction and then this desired fraction passes into an indent or pocket-type separator drum. This indent drum includes two sections, the first section which removes seeds shorter than the desired length and the second section which removes and discharges longer than desired seeds. The remaining seed is fed from the second section and collected at the discharge end of a trough pick up of the indent drum.

31 Claims, 13 Drawing Figures

ROTARY SEED CLEANER

BACKGROUND OF THE INVENTION

This invention relates to new and useful improvements in seed cleaning machines, particularly self-contained seed cleaning machines which are designed specifically for use on farms or the like and adapted to be driven by two relatively low horsepower electric motors from a conventional source of power such as 110 VAC.

However it will of course be appreciated that larger scale machines can be made utilizing the same principles so that this specification should not be construed as being limited to the relatively small machine.

It is recognized that if a farmer can clean his own seed, then better grades can be developed and better prices received.

There are many seed cleaners on the market all of which utilize one or more of well known seed cleaning principles but unfortunately few of them incorporate a complete seed cleaning facility which utilizes rotating seed cleaners rather than reciprocating seed cleaners and in which the various seed cleaning drums can readily be changed by the operator so that it can be utilized for cleaning all types of seed and although the various seed cleaning functions are well known, nevertheless they are assembled in a novel relationship and include several novel features which make the seed cleaner most suitable for use by an individual farm operator.

SUMMARY OF THE INVENTION

In accordance with the invention there is provided a rotary cleaner for grain seeds and the like comprising in combination a supporting framework, a source of power, a scalper drum separator mounted within said framework, an intake auger operatively connected to said scalping drum separator and rotated thereby, separating means for separating seed by widths, the discharge of the desirable fraction from said scalper drum feeding into said separator means, said separator means separating seed into a desirable and an undesirable fraction by width, and an indent separator in said framework, receiving the desirable fraction from said separator means and separating the seed into desirable and undesirable fractions by length, all of said separators being operatively connected to said source of power.

Another aspect of the invention may be stated to comprise a rotary cleaner for grain seeds and the like comprising in combination supporting framework and a source of power and including a plurality of stages, said stages comprising: a first stage consisting of means to remove all material from the seed being cleaned that is thicker than the desired seed, a second stage consisting of means to remove all materials lighter than the desired seed, a third stage consisting of means to remove all materials thinner than the desired seed, a fourth stage consisting of means to remove all materials shorter than the desired seed and, a fifth stage consisting of means to remove all materials longer than the desired seed, each stage, in sequence, separating the material into an undesirable fraction and a desirable fraction and means feeding the desirable fraction from each stage to the intake of the next succeeding stage.

An advantage of the invention is that the preferred seed fraction is retained and fed to the next succeeding stage whereas the undesirable fraction is discharged at the end of each stage and may be collected for either disposal or further use as feed or the like.

Still another advantage of the invention is to provide a device of the character herewithin described which is adaptable for use in receiving seed from a truck, a grain bin or the like inasmuch as an intake auger is included.

A further advantage, in conjunction with the foregoing advantage is that the intake auger is driven by the scalper drum which in turn is provided with means to vary the speed thereof so that the intake of seed to be cleaned may be adjusted to suit the capabilities of the machine in conjunction with the particular seed being cleaned.

Still another advantage of the invention is to provide a device of the character herewithin described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
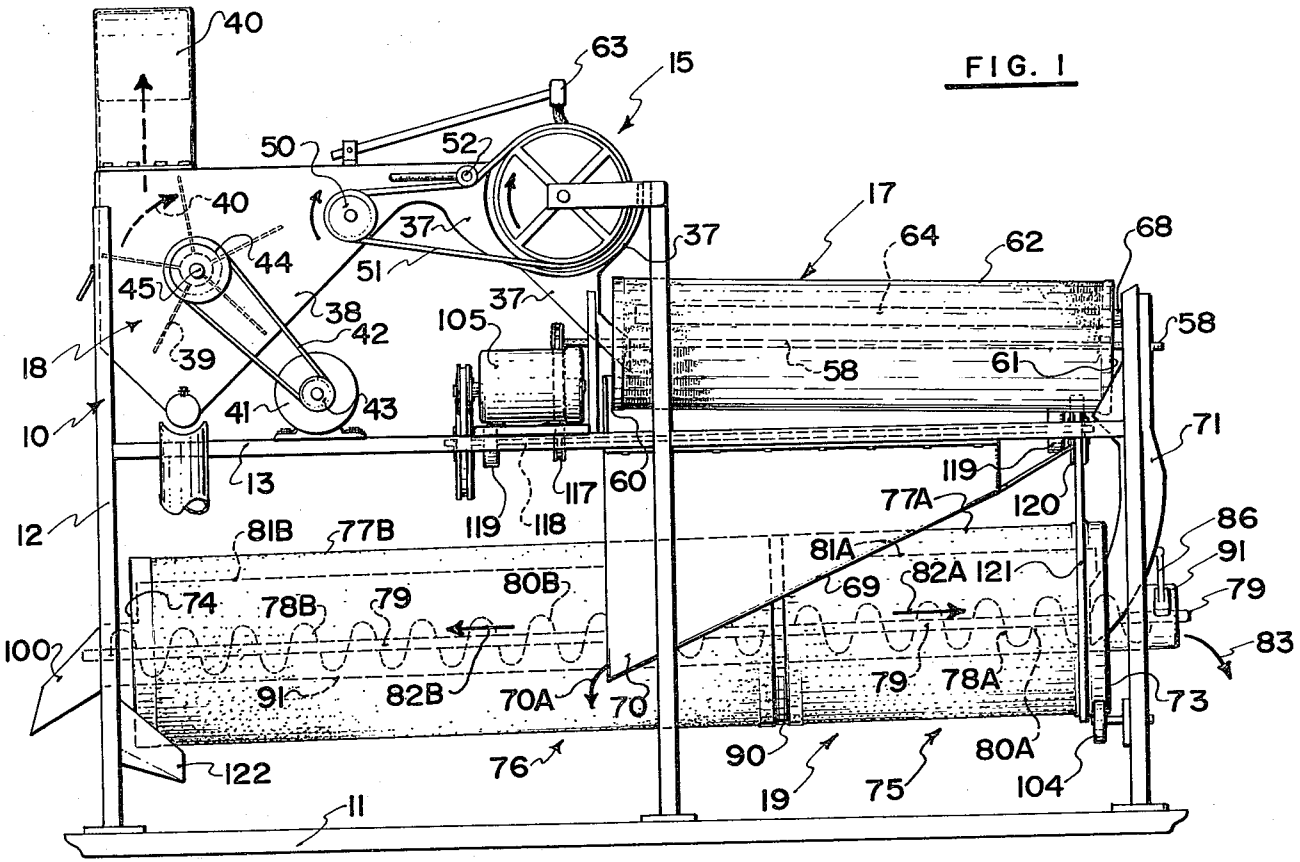
FIG. 1 is a partially schematic side elevation of the device.

Proceeding therefore to describe the invention in detail, reference should first be made to FIGS. 1 and 2 in which 10 illustrates supporting framework comprising a substantially rectangular base 11, upright members 12 and longitudinally extending members 13 together with various transverse members 14 all of which act as supports for the framework and for various components as will hereinafter become apparent.

The various separating stages are illustrated, the first stage being a scalping drum separator collectively designated 15 having an intake auger assembly collectively designated 16. The scalper drum separates the grain sample into a desirable fraction and an undesirable fraction, the undesirable fraction including all material thicker than the desired fraction.

This desired fraction is then fed to a twin shell or drum separator collectively designated 17 and as it passes to the separators 17, it is acted upon by an adjustable air separator collectively designated 18 which removes all material lighter than the desired seed and allows the remainder to be fed to the separators 17.

Separators 17 remove all material thinner than the desired seed with the desired fraction passing over the ends of these separators and being fed to the first section of an indent separator collectively designated 19. The first section removes all material shorter than the desired seed and allows the desired fraction to pass to the second section which removes all material longer than the desired seed thereafter discharging the desired seed at one end thereof.

In detail, the scalper drum is an open ended drum having spiders 20 and 21 at each end thereof supporting a perforated cylindrical screen 22 and including a pipe or tube 23 extending axially between the spider with a stationary shaft 24 supported at one end thereof within brackets 25 engaging through the tube 23 thus mounting the scalper drum separator, for rotation upon the stationary shaft 24.

The intake end 26 of the scalper drum receives grain for the intake or feed auger 16 and this auger includes an auger tube 27, and an auger shaft and flight 28 journalled for rotation therein and having a conventional intake 29 at the lower end thereof.

The upper end of the auger shaft includes a universal joint assembly collectively designated 30 which rotates a short length of tubing 31 which engages over the distal end of shaft 24 in the form of a spigot bearing to offer support to this short length of tubing which of course is rotated by the auger shaft and flight 28 via the universal joint assembly 30.

A plurality of fingers diverge outwardly from the tube 31 and engage the intake end of the scalper drum assembly, engaging the legs of the spider 21 so that as the scalper drum rotates, it rotates the auger flight and shaft 28. The auger assembly is readily attached and detached from the supporting frame and in this connection a pair of stub shafts 33 extend outwardly upon either side of the auger tube 27 adjacent the upper end thereof, one of the stub shafts engaging a short length of tubing 34 secured to an upright support member 12A with the other stub shaft engaging a hook 35 on a further vertical support member 12A one upon each side of the scalper drum. This positions the discharge end of the auger assembly in operative position relative to the intake of the scalper drum so that grain may be augered upwardly from a grain bin, hopper or the like (not illustrated) and deposited within the scalper drum.

Drive means for the drum will be described later but as the scalper drum rotates, any material such as grain heads or the like will not pass through the screen 22 but will be discharged over the end 26A and guided by a chute 36 into a convenient receptacle (not illustrated).

The desired fraction will pass through the screen into a collecting trough 37 which leads to the aforementioned twin drum separator 17. As it passes through the screen into the trough or collector chute 37, it is acted upon by the air separator 18. This is situated within a casing 38 supported within a supporting framework and including a fan assembly 39 which is conventional and which rotates in the direction of arrow 40 as will hereinafter be described. This draws air from each end of the chute 37 and through the scalper drum assembly picking up any dust, chaff and light fraction and discharging dust and very light material, through the air discharge 40 situated on the upper side of casing 38 and allowing heavier material to collect in the base of the casing. This air separator removes all material lighter than the desired seed and the air discharge may be rotated in any direction depending upon the choice of the operator.

The air stream is adjustable by adjusting a hinged door or flap 18A situated in the wall of the casing 38.

A source of power in the form of a small electric motor 41 is mounted upon the supporting structure as illustrated in FIG. 1 and a belt 42 extends around the drive pulley 43 on the motor shaft and around a pulley 44 secured to the shaft 45 of the fan assembly 39.

Figure 12:
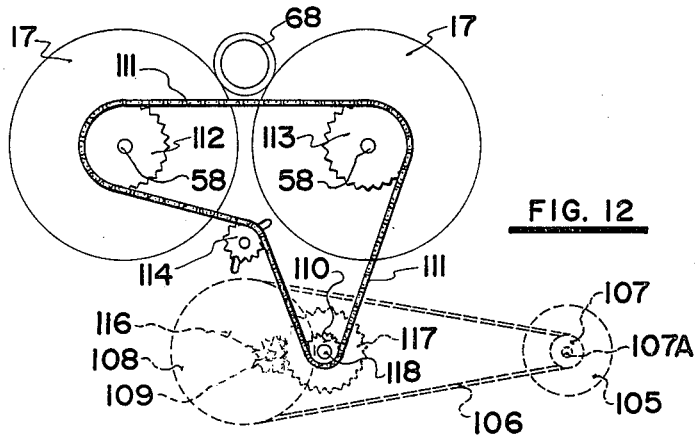
FIG. 12 is a schematic view of the drive for the twin drums of the separator section.

As shown in FIG. 12, a further pulley 46 is situated on the opposite end of shaft 45 and a belt 47 extends around this pulley 46 and around a pulley 48 secured to shaft 49 which extends transversely across the housing 38 and drives pulley 50.

A further belt 51 extends around pulley 50 and around the periphery of the scalping drum 15 to rotate same and of course the intake auger assembly. A spring loaded roller 52 maintains the tension within belt 51 and the speed of rotation of the scalping drum and of course the intake auger is controlled by pulley 50 which is in the form of an adjustable V-pulley which is conventional so that details thereof are not believed necessary. Also pulley 48A is concentric with pulley 48 and belt 47A drives pulley 48B on auger shaft 49A at the base of the casing which ejects the heavier material deposited there from the air flow. Additional control of the grain picked up by the intake auger is by way of an adjustable sliding cover 29A which adjusts the opening of the intake 29.

The desired fraction passing through chute 37 is fed into the intake or upper ends of the twin drum separators 17 and in this connection a grain flow divider 53 (shown schematically in FIG. 3) is adjustable by an externally extending lever 54 so that the desired fraction passing from the scalping drum, is divided equally into the two drums each of which is specifically designated 55A and 55B. In this connection the fixed divider 56 at the base of the chute 37 should be noted.

Figure 3:
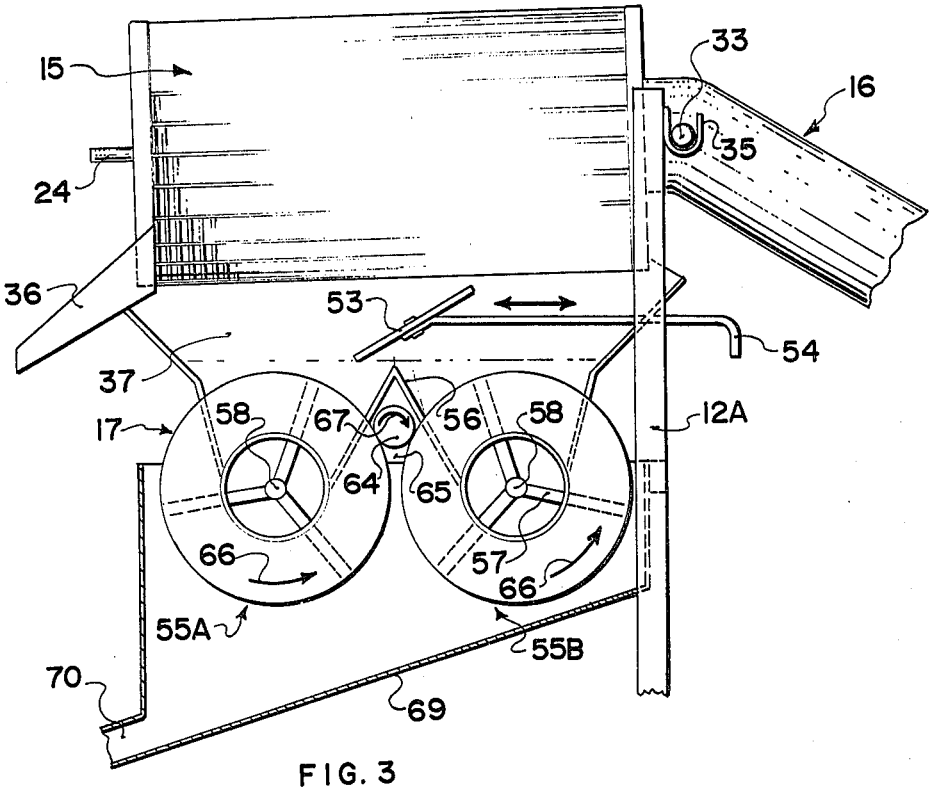
FIG. 3 is an enlarged fragmentary end elevation of the upper portion of the machine taken from the righthand end of FIG. 1.
Figure 6:
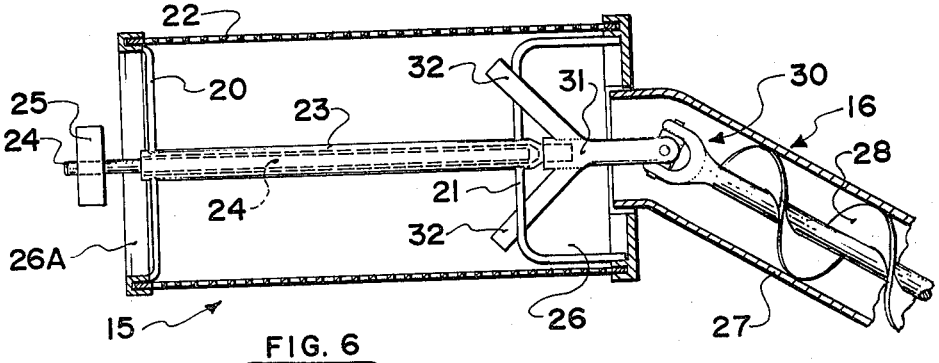
FIG. 6 is a partially sectioned fragmentary view showing the attachment of the intake auger assembly to the scalper drum.
Figure 7:
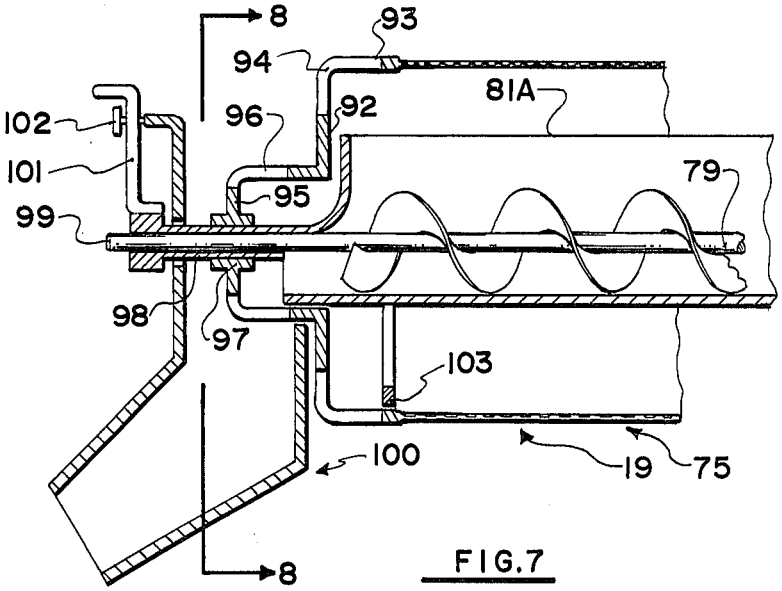
FIG. 7 is an enlarged fragmentary cross sectional view of the end section of the indent drum at the discharge end thereof.

Each separator drum 55A and 55B includes spiders at each end, one of which 57 is shown in FIG. 3, said spiders being secured to the axial shaft 58 which mount the drums for rotation within the supporting framework including cross member 59 at the discharge end thereof and similar structure (not illustrated) at the intake end thereof and it will be noted from FIG. 1 that these two side by side separator drums or shells incline downwardly from the intake end 60 towards the discharge end 61 so that grain retained within the shells as they rotate, travels towards the discharge end.

Once again the means for driving these drums in the same direction will be described later and the drums comprise perforated cylindrical walls 62 which are sized so that any material thinner than the desired seed passes through the interstices of the walls with the desired fraction remaining within the drums and travelling towards the discharge end 61.

Reverting back to the scalping drum, a transversely extending brush assembly 63 is situated so that the brush engages the outer surface of the drum as it rotates thereby clearing any debris from the drum and maintaining the interstices in an open condition.

In the case of the separator drums 62, because of the configuration of the interstices and the fact that material thinner than the desired seed is adapted to pass through, seeds sometimes become wedged in these interstices and are difficult to remove.

I have therefore provided a longitudinally extending roller 64 preferably having a resilient cover and resting freely in what I define as the upper cuspal area 65 between the two rollers as clearly shown in FIG. 3. Inasmuch as the rollers are rotating in the same direction as indicated by arrows 66, this free roller 64 will rotate in the direction of arrow 67 and will disengage any seeds that are jammed through the interstices of the walls 62. As shown in FIG. 1, the lower end 68 of this roller will rest against the transverse member 14 so that it will not become displaced.

The undesirable fraction passing through the screens 17 is collected by means of a collector trough 69 and discharged over the end in the direction of arrow 70A to be collected if desired and it will be noted that this open end 70 is situated on the same side of the machine as is the discharge 36 which is immediately thereabove.

The desired fraction passing through the separators 17 is collected in the end collector 71 and fed to spout 72 which in turn engages in the open intake end 73 of the indent separator or drum assembly 19 and once again it will be noted that this assembly inclines downwardly from the intake end 73 towards the discharge end 74.

This indent drum is provided with two sections, a first section collectively designated 75 and a second section collectively designated 76. The indent drum 77A and 77B is conventional in configuration and contains indentations or pockets and in the first section 75, these pockets are sized to remove all material shorter than the desired seed whereas in the second section 76, they are sized to remove all material longer than the desired seed. As the construction of such shells is well known, it is not believed necessary to describe same further.

Auger assemblies 78A and 78B are provided within the section 75 and 76 respectively and consist of auger shaft 79 with auger flights 80A and 80B secured thereto. The first section 75, which is considerably shorter than the second section 76, includes a conventional trough 81 partially surrounding the auger of that section and receiving the seeds which are shorter than the desired seed, from the indents or pockets of this portion of the separator. The auger flight 79 is rotated so that the material collected in the trough 81 is augered upwardly in the direction of arrow 82 and discharged over the end of the auger 83 to be collected in a container (not illustrated).

The trough terminates in a cylindrical collar 84 at the intake end which also supports the end of the auger shaft 79 and this collar is clamped in position by means of wing nut and bolt 85 but can be partially rotated by handle 86 once the wing nut and bolt 85 are loosened so that the relationship of the trough 81 relative to the auger assembly may be adjusted to receive the material held within the indents or pockets of this section of the auger. Furthermore, when it is desired to clean out the auger assembly, the trough may be completely up ended so that all material is discharged therefrom.

Figure 10:
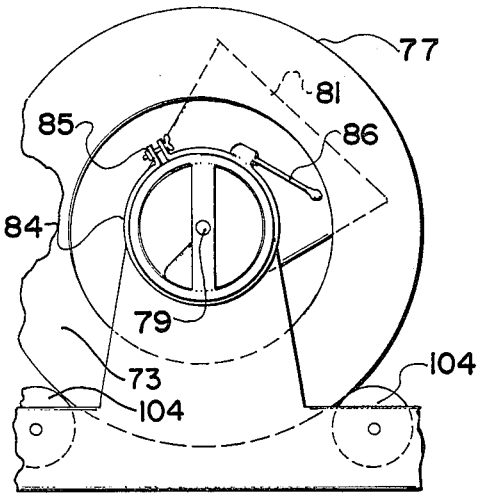
FIG. 10 is an enlarged fragmentary end view of the indent drum taken at the opposite end to that shown in FIG. 8.
Figure 11:
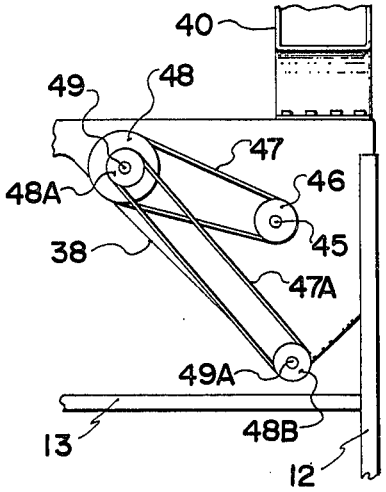
FIG. 11 is a fragmentary side view of the air cleaner per se.

The lower auger assembly 78B includes an extension of shaft 79 and auger flight 80B secured thereto and reference should be made to FIG. 10 which shows the connection between the two auger shaft portions 79A and 79B. They are provided with square or similar cross sectionally shaped ends 87 which engage within a similarly cross sectioned shaped sleeve 88 and which in turn is secured to the junction between the shell sections 77A and 77B, by means of a spider 89, reference character 90 illustrating the junction between the two sections in FIG. 1.

This means that as the cylinder or separator 19 is rotated as will hereinafter be described, similar rotation is given to the two auger assemblies.

Figure 8:
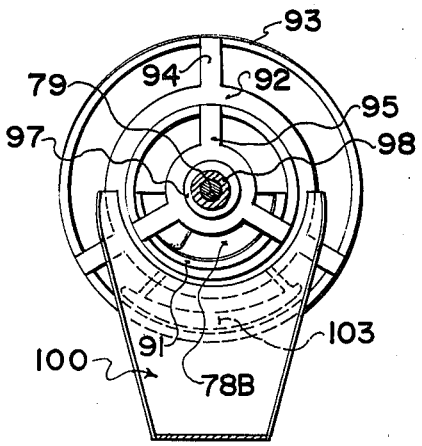
FIG. 8 is a fragmentary section substantially along the line 8—8 of FIG. 7.

The second section 76 is provided with a similar connecting trough 91 partially surrounding the auger of this section and reference to FIG. 8 will show the mounting of the lower end of this separator.

A first disc 92 is connected to the lower end 93 of the shell or wall 77B by means of a plurality of angulated legs 94 and a second disc 95 is connected to the inner circumference of the first disc by further angulated legs 96. Disc 95 is secured to hub 97 which is journalled for rotation upon a stationary tube 98 extending through the end supporting structure and through which the lower end 99 of the auger shaft 79 is bearingly supported.

Figure 9:
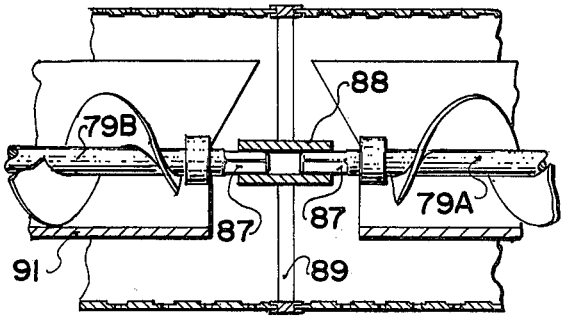
FIG 9 is a fragmentary longitudinal section of the indent drum showing the junction between the two sections and the drive therefor.

A collector chute 100 is engaged upon the stationary tube 98 and supported thereby and extends as shown in FIG. 9, to receive material passing over the end of the section 76 of the indent separator. This is the preferred fraction of grain after it has passed through all of the separator sections.

A level 101 extends upwardly from the tube 98 and is rotatable in an arc together with the trough 91 so that the trough may be adjusted relative to receiving the seed from the indents or pockets of the drum and once again it may be rotated completely in order to dump the trough for clean out purposes. A detachable latch device 102 extends from the upper side of the trough 100 to detachably retain the lever 101 in the desired position.

A retarder 103 spans the base of the discharge end of the shell or cylinder as it is desirable to maintain a quantity of grain within the trough for the most efficient operation of this device. This retarder is arcuate in configuration and is supported from the end of trough 91.

Figures 2, 4, 5:
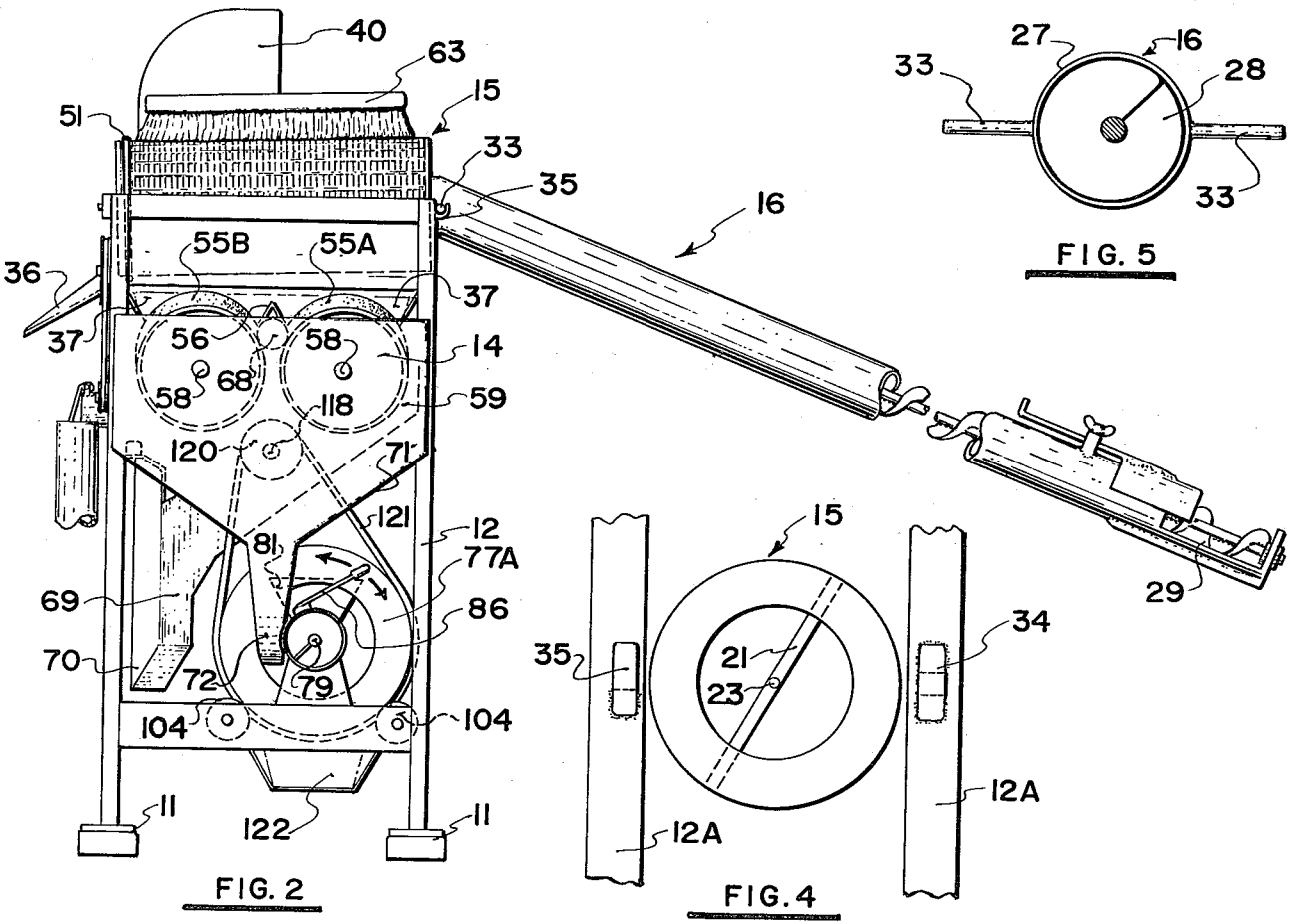
FIG. 2 is an end view of the device taken from the righthand end of FIG. 1.
FIG. 4 is a fragmentary side view showing the intake end of the scalper drum.
FIG. 5 is an end view of the intake end of the intake auger assembly.

The upper end of the indent separator 19 is supported for rotation between a pair of rollers 104 one upon each side thereof as clearly shown in FIGS. 1 and 2.

Figure 13:
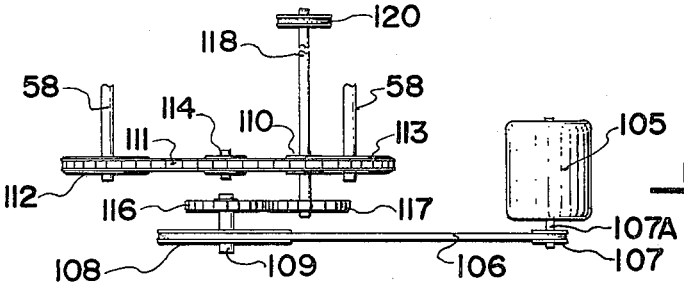
FIG. 13 is a schematic plan view of the drive of FIG. 12.

Drive for the separators 17 and 19 is via a second electric motor shown schematically in FIG. 1 and identified by reference character 105. The drive is shown schematically in FIG. 13 and includes a belt 106 around pulley 107 secured to the motor drive shaft 107A and extending around a pulley 108 supported within the supporting framework. The pulley 108 is mounted upon a shaft 109 and shaft 109 also carries a gear 116 shown in FIG. 12, engaging with a further gear 117 secured to a shaft 118 illustrated also in FIG. 1. A chain sprocket 110 is also mounted on shaft 118 and a sprocket chain 111 extends around this sprocket and around a further sprocket 112 which is secured to the shaft 58 of one of the drum separators 17, and sprocket 113 which is secured to the shaft 58 of the other drum separator thus rotating these two drums in the same direction.

A chain adjusting sprocket 114 is mounted in slot 115 in a conventional manner and is for the adjustment of the tension of chain 111 on the slack side thereof.

The shaft 118 is mounted between bearings 119 on the supporting structure and the shaft extends rearwardly towards the intake end of the indent separator 19. A pulley 120 is secured to the shaft towards the rear end thereof and belt 121 extends around this pulley and around the drum 77A adjacent the intake end thereof as clearly shown in FIG. 1.

This supplies drive to this portion of the separator namely the separators 17 and 19 together with the augers within 19.

It will therefore be seen that a complete rotary separator is provided which includes a plurality of stages, each stage dividing the material passing therethrough into the desired fraction and the undesired fraction with the undesired fractions being discharged externally of the machine. The desired fractions pass from one stage to the other and are further refined until the final discharge via chute 100.

Summarizing, the grain to be cleaned is first picked up by the intake auger assembly 16 driven by the first stage separator, namely, the scalping drum assembly 15 which separates the material and removes all material from the seed being cleaned that is thicker than the desired seed and discharges this thicker material over the end of the scalping drum.

The desired fraction passes from the scalping drum into the twin separator assemblies 17 with the second stage acting on this material as it passes from stage 1 to stage 3.

This second stage comprises the air separator 18 and this removes all material that is lighter than the desired seed allowing the remainder to pass into the twin separators 17.

This third stage separates all material that is thinner than the desired seed and discharges the undesirable fraction into the chute 69 with the desirable fraction passing over the end of these separators and being fed into the intake end of the fourth and fifth stages which comprise the indent separator 19.

The first stage removes all material shorter than the desired seed and augers the undesirable fraction over the end 83 with the desired fraction passing into the second section which removes all material longer than the desired seed and collects the desired fraction and discharges same through the chute 100.

The undesired fraction from this last separator stage passes over the end of the separator stage and is discharged through the chute 122.

Finally, it should be noted that the separator drums 17 reject all seed thinner than required when used for wheat and barley. However, if used for other seed such as flax seed or the like, another drum perforation is required as these seeds are round or flat. Circular apertures are used and separate by diameter or overall size.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention:

1. A rotary cleaner for grain seeds and the like comprising in combination a supporting framework, a source of power, a scalper drum separator mounted within said framework, an intake auger operatively connected to said scalping drum separator and rotated thereby, separating means for separating seed by widths, the discharge of the desirable fraction from said scalper drum feeding into said separator means, said separator means separating seed into a desirable and an undesirable fraction by width, and an indent separator in said framework, receiving the desirable fraction from said separator means and separating the seed into desirable and undesirable fractions by length, all of said separators being operatively connected to said source of power, said indent separator means including a first section removing seeds shorter than the desired length and a second section for removing seeds longer than the desired length.

2. The invention according to claim 1 which includes air separating means between said scalper drum and said separator means.

3. The invention according to claim 2 in which said separator means comprises a pair of rotatable separating drums mounted for rotation within said framework in side by side relationship and being inclined at a slight angle to the horizontal from the intake end thereof towards the discharge end thereof.

4. The invention according to claim 3 in which said pair of drums are perforated and which includes means to remove seeds caught within the perforations of said drums, said last mentioned means comprising a elongated roller freely engaged in the upper cuspal area between said drums, said drums rotating in the same direction, said roller having a resilient outer surface.

5. The invention according to claim 1 in which said separator means comprises a pair of rotatable separating drums mounted for rotation within said framework in side by side relationship and being inclined at a slight angle to the horizontal from the intake end thereof towards the discharge end thereof.

6. The invention according to claim 5 in which said pair of drums are perforated and which includes means to remove seeds caught within the perforations of said drums, said last mentioned means comprising a elongated roller freely engaged in the upper cuspal area between said drums, said drums rotating in the same direction, said roller having a resilient outer surface.

7. The inventon according to claims 1, 2 or 5 in which the rotation of said scalper drum separator drives said intake auger, means to vary the speed of rotation of said scalper drum separator and hence the speed of said intake auger and means operatively connecting said scalper drum separator to said intake auger, said scalper drum separator including a spider at the intake end thereof, a spigot support bearing at said intake end, said intake auger including an auger tube, a shaft and flight rotatable therein and an auger intake at the lower end thereof, a universal joint assembly at the discharge end thereof, said universal joint assembly including means operatively engaging said spigot support bearing and a plurality of fingers extending from said universal joint assembly freely engaging within said spider and being rotated thereby, and means extending from the sides of said auger tube adjacent the discharge end thereof hooking onto said supporting structure to mount said auger assembly in operative relationship with the intake end of said scalper drum separator.

8. The invention according to claims 3, 6 or 4 in which the rotation of said scalper drum separator drives said intake auger, means to vary the speed of rotation of said scalper drum separator and hence the speed of said intake auger and means operatively connecting said scalper drum separator to said intake auger, said scalper drum separator including a spider at the intake end thereof, a spigot support bearing at said intake end, said intake auger including an auger tube, a shaft and flight rotatable therein and an auger intake at the lower end thereof, a universal joint assembly at the discharge end thereof, said universal joint assembly including means operatively engaging said spigot support bearing and a plurality of fingers extending from said universal joint assembly freely engaging within said spider and being rotated thereby, and means extending from the sides of said auger tube adjacent the discharge end thereof hooking onto said supporting structure to mount said auger assembly in operative relationship with the intake end of said scalper drum separator.

9. The invention according to claims 1, 2 or 5 in which said indent drum includes a collecting auger for each section situated axially through said drum, a collecting trough under each auger, means mounting said troughs for selective radial position relative to said augers and means to invert said troughs to dump same for clean out purposes, the trough of said second section including a retarding plate at the discharge end thereof.

10. The invention according to claims 3, 6 or 4 in which said indent drum includes a collecting auger for each section situated axially through said drum, a collecting trough under each auger, means mounting said troughs for selective radial position relative to said augers and means to invert said troughs to dump same for clean out purposes, the trough of said second section including a retarding plate at the discharge end thereof.

11. A rotary cleaner for grain seeds and the like comprising in combination supporting framework and a source of power and including a plurality of stages, said stages comprising:

(a) a first stage consisting of means to remove all material from the seed being cleaned that is thicker than the desired seed, (b) a second stage consisting of means to remove all materials lighter than the desired seed, (c) a third stage consisting of means to remove all materials thinner than the desired seed, (d) a fourth stage consisting of means to remove all materials shorter than the desired seed and, (e) a fifth stage consisting of means to remove all materials longer than the desired seed, each stage, in sequence, separating the material into an undesirable fraction and a desirable fraction and means feeding the desirable fraction from each stage to the intake of the next succeeding stage, said first stage including a scalper drum separator with an intake auger operatively connected thereto and rotated thereby, said second stage including air separator means between said first stage and said third stage, said third stage including a pair of rotatable separating drums mounted for rotation within said framework in side by side relationship, said fourth and fifth stages including indent separating means, said indent separating means including a front section for removing seeds shorter than the desired length and a second section for removing seeds longer than the desired length, the rotation of said scalper drum separator driving said intake auger, means to vary the speed of rotation of said scalper drum separator and hence the speed of said intake auger and means operatively connecting said scalper drum separator to said intake auger, said scalper drum separator including a spider at the intake end thereof, a spigot support bearing at said intake end, said intake auger including an auger tube, a shaft and flight rotatable therein and an auger intake at the lower end thereof, a universal joint assembly at the discharge end thereof, said universal joint assembly including means operatively engaging said spigot support bearing and a plurality of fingers extending from said universal joint assembly freely engaging within said spider and being rotated thereby, and means extending from the sides of said auger tube adjacent the discharge end thereof hooking onto said supporting structure to mount said auger assembly in operative relationship with the intake end of said scalper drum separator.

12. The invention according to claim 11 in which said separator means comprises a pair of rotatable separating drums mounted for rotation within said framework in side by side relationship and being inclined at a slight angle to the horizontal from the intake end thereof towards the discharge end thereof.

13. A rotary cleaner for grain seeds and the like comprising in combination a supporting framework, a source of power, a scalper drum separator mounted within said framework, an intake auger operatively connected to said scalping drum separator and rotated thereby, separating means for separating seed by widths, the discharge of the desirable fraction from said scalper drum feeding into said separator means, said separator means separating seed into a desirable and an undesirable fraction by width, and an indent separator in said framework, receiving the desirable fraction from said separator means and separating the seed into desirable and undesirable fractions by length, all of said separators being operatively connected to said source of power, the rotation of said scalper drum separator driving said intake auger, means to vary the speed of rotation of said scalper drum separator and hence the speed of said intake auger and means operatively connecting said scalper drum separator to said intake auger, said scalper drum separator including a spider at the intake end thereof, a spigot support bearing at said intake end, said intake auger including an auger tube, a shaft and flight rotatable therein and an auger intake at the lower end thereof, a universal joint assembly at the discharge end thereof, said universal joint assembly including means operatively engaging said spigot support bearing and a plurality of fingers extending from said universal joint assembly freely engaging within said spider and being rotated thereby, and means extending from the sides of said auger tube adjacent the discharge end thereof hooking onto said supporting structure to mount said auger assembly in operatively relationship with the intake end of said scalper drum separator.

14. The invention according to claim 13 which includes air separating means between said scalper drum and said separator means.

15. The invention according to claim 14 in which said separator means comprises a pair of rotatable separating drums mounted for rotation within said framework in side by side relationship and being inclined at a slight angle to the horizontal from the intake end thereof towards the discharge end thereof.

16. The invention according to claim 13 in which said separator means comprises a pair of rotatable separating drums mounted for rotation within said framework in side by side relationship and being inclined at a slight angle to the horizontal from the intake end thereof towards the discharge end thereof.

17. The invention according to claims 16 or 15 in which said pair of drums are perforated and which includes means to remove seeds caught within the perforations of said drums, said last mentioned means comprising a elongated roller freely engaged in the upper cuspal area between said drums, said drums rotating in the same direction, said roller having a resilient outer surface.

18. The invention according to claims 13, 14 or 16 in which the rotation of said scalper drum separator drives said intake auger, means to vary the speed of rotation of said scalper drum separator and hence the speed of said intake auger and means operatively connecting said scalper drum separator to said intake auger, said scalper drum separator including a spider at the intake end thereof, a spigot support bearing at said intake end, said intake auger including an auger tube, a shaft and flight rotatable therein and an auger intake at the lower end thereof, a universal joint assembly at the discharge end thereof, said universal joint assembly including means operatively engaging said spigot support bearing and a plurality of fingers extending from said universal joint assembly freely engaging within said spider and being rotated thereby, and means extending from the sides of said auger tube adjacent the discharge end thereof hooking onto said supporting structure to mount said auger assembly in operative relationship with the intake end of said scalper drum separator.

19. The invention according to claims 13, 14 or 16 in which said indent means includes an indent drum, said indent drum including a collecting auger for each section situated axially through said drum, a collecting trough under each auger, means mounting said troughs for selective radial position relative to said augers and means to invert said troughs to dump same for clean out purposes, the trough of said second section including a retarding plate at the discharge end thereof.

20. A rotary cleaner for grain seeds and the like comprising in combination a supporting framework, a source of power, a scalper drum separator mounted within said framework, an intake auger operatively connected to said scalping drum separator and rotated thereby, separating means for separating seed by widths, the discharge of the desirable fraction from said scalper drum feeding into said separator means, said separator means separating seed into a desirable and an undesirable fraction by width, and an indent separator in said framework, receiving the desirable fraction from said separator means and separating the seed into desirable and undesirable fractions by length, all of said separators being operatively connected to said source of power, the rotation of said scalper drum separator driving said intake auger, means to vary the speed of rotation of said scalper drum separator and hence the speed of said intake auger and means operatively connecting said scalper drum separator to said intake auger, said scalper drum separator including a spider at the intake end thereof, a spigot support bearing at said intake end, said intake auger including an auger tube, a shaft and flight rotatable therein and an auger intake at the lower end thereof, a universal joint assembly at the discharge end thereof, said universal joint assembly including means operatively engaging said spigot support bearing and a plurality of fingers extending from said universal joint assembly freely engaging within said spider and being rotated thereby, and means extending from the sides of said auger tube adjacent the discharge end thereof hooking onto said supporting structure to mount said auger assembly in operative relationship with the intake end of said scalper drum separator.

21. The invention according to claim 20 which includes air separating means between said scalper drum and said separator means.

22. The invention according to claim 21 in which said separator means comprises a pair of rotatable separating drums mounted for rotation within said framework in side by side relationship and being inclined at a slight angle to the horizontal from the intake end thereof towards the discharge end thereof.

23. The invention according to claim 20 in which said separator means comprises a pair of rotatable separating drums mounted for rotation within said framework in side by side relationship and being inclined at a slight angle to the horizontal from the intake end thereof towards the discharge end thereof.

24. The invention according to claims 21, 23 or 22 in which the rotation of said scalper drum separator drives said intake auger, means to vary the speed of rotation of said scalper drum separator and hence the speed of said intake auger and means operatively connecting said scalper drum separator to said intake auger, said scalper drum separator including a spider at the intake end thereof, a spigot support bearing at said intake end, said intake auger including an auger tube, a shaft and flight rotatable therein and an auger intake at the lower end thereof, a universal joint assembly at the discharge end thereof, said universal joint assembly including means operatively engaging said spigot support bearing and a plurality of fingers extending from said universal joint assembly freely engaging within said spider and being rotated thereby, and means extending from the sides of said auger tube adjacent the discharge end thereof hooking onto said supporting structure to mount said auger assembly in operative relationship with the intake end of said scalper drum separator.

25. The invention according to claim 20 in which said indent separator means includes a first section removing seeds shorter than the desired length and a second section for removing seeds longer than the desired length.

26. The invention according to claim 20 in which said indent separator means includes a first section removing seeds shorter than the desired length and a second section for removing seeds longer than the desired length.

27. The invention according to claim 20 in which said indent separator means includes a first section removing seeds shorter than the desired length and a second section for removing seeds longer than the desired length.

28. The invention according to claim 20 in which said indent separator means includes a first section removing seeds shorter than the desired length and a second section for removing seeds longer than the desired length.

29. The invention according to claims 15, 17 or 20 in which the rotation of said scalper drum separator drives said intake auger, means to vary the speed of rotation of said scalper drum separator and hence the speed of said intake auger and means operatively connecting said scalper drum separator to said intake auger, said scalper drum separator including a spider at the intake end thereof, a spigot support bearing at said intake end, said intake auger including an auger tube, a shaft and flight rotatable therein and an auger intake at the lower end thereof, a universal joint assembly at the discharge end thereof, said universal joint assembly including means operatively engaging said spigot support bearing and a plurality of fingers extending from said universal joint assembly freely engaging within said spider and being rotated thereby, and means extending from the sides of said auger tube adjacent the discharge end thereof hooking onto said supporting structure to mount said auger assembly in operative relationship with the intake end of said scalper drum separator.

30. The invention according to claims 25, 26 or 27 in which the rotation of said scalper drum separator drives said intake auger, means to vary the speed of rotation of said scalper drum separator and hence the speed of said intake auger and means operatively connecting said scalper drum separator to said intake auger, said scalper drum separator including a spider at the intake end thereof, a spigot support bearing at said intake end, said intake auger including an auger tube, a shaft and flight rotatable therein and an auger intake at the lower end thereof, a universal joint assembly at the discharge end thereof, said universal joint assembly including means operatively engaging said spigot support bearing and a plurality of fingers extending from said universal joint assembly freely engaging within said spider and being rotated thereby, and means extending from the sides of said auger tube adjacent the discharge end thereof hooking onto said supporting structure to mount said auger assembly in operative relationship with the intake end of said scalper drum separator.

31. The invention according to claim 28 in which the rotation of said scalper drum separator drives said intake auger, means to vary the speed of rotation of said scalper drum separator and hence the speed of said intake auger and means operatively connecting said scalper drum separator to said intake auger, said scalper drum separator including a spider at the intake end thereof, a spigot support bearing at said intake end, said intake auger including an auger tube, a shaft and flight rotatable therein and an auger intake at the lower end thereof, a universal joint assembly at the discharge end thereof, said universal joint assembly including means operatively engaging said spigot support bearing and a plurality of fingers extending from said universal joint assembly freely engaging within said spider and being rotated thereby, and means extending from the sides of said auger tube adjacent the discharge end thereof hooking onto said supporting structure to mount said auger assembly in operative relationship with the intake end of said scalper drum separator.

* * * * *